US005333787A

United States Patent [19]

Smith et al.

[11] Patent Number: 5,333,787

[45] Date of Patent: Aug. 2, 1994

[54] NOZZLE WITH SELF CONTROLLED OSCILLATION

[76] Inventors: Leary W. Smith, 3665 Keswick Dr., Chamblee, Ga. 30341; Clifford H. Boylston, 1892 Surry Trail, Conyers, Ga. 30208

[21] Appl. No.: 8,660

[22] Filed: Jan. 25, 1993

Related U.S. Application Data

[63] Continuation-in-part of Ser. No. 831,420, Feb. 5, 1992, abandoned.

[51] Int. Cl.[5] ..... B05B 3/16

[52] U.S. Cl. ..... 239/227; 239/233; 239/255; 239/504; 239/505; 239/587.2; 239/587.6; 34/97; 15/405

[58] Field of Search ..... 239/227, 229, 231, 233, 239/251, 255, 504, 505, 587.2, 587.5, 587.6; 15/344, 405; 34/96, 97

[56] References Cited

U.S. PATENT DOCUMENTS

| | | | |
|---|---|---|---|
| 2,531,566 | 11/1950 | Gustafson | 239/255 X |
| 2,980,340 | 4/1961 | McEachern | 239/505 X |
| 4,010,902 | 3/1977 | Speyer | 239/587.5 X |
| 4,526,321 | 7/1985 | Knudsen | 239/255 X |
| 4,716,604 | 1/1988 | Watkins | 239/229 X |
| 4,773,594 | 9/1988 | Clearman | 239/233 X |

FOREIGN PATENT DOCUMENTS

| | | | |
|---|---|---|---|
| 699339 | 11/1940 | Fed. Rep. of Germany | 239/233 |

*Primary Examiner*—Andres Kashnikow
*Assistant Examiner*—William Grant
*Attorney, Agent, or Firm*—James B. Middleton

[57] ABSTRACT

A nozzle for providing an oscillating fluid stream has a stationary segment, and at least one oscillating segment pivoted to the stationary segment. In one embodiment, the fluid stream impinges on an inwardly turned lip on the oscillating segment to drive the oscillation. In other embodiments, the reaction of the fluid discharge assists in driving the oscillation of the nozzle, with or without assistance of the inwardly turned lip. For high pressure systems, including the use of liquids, the segments may be more massive to redirect the fluid stream. For compact systems, the plural segments may be completely housed within the stationary segment.

9 Claims, 4 Drawing Sheets

Fig. 8
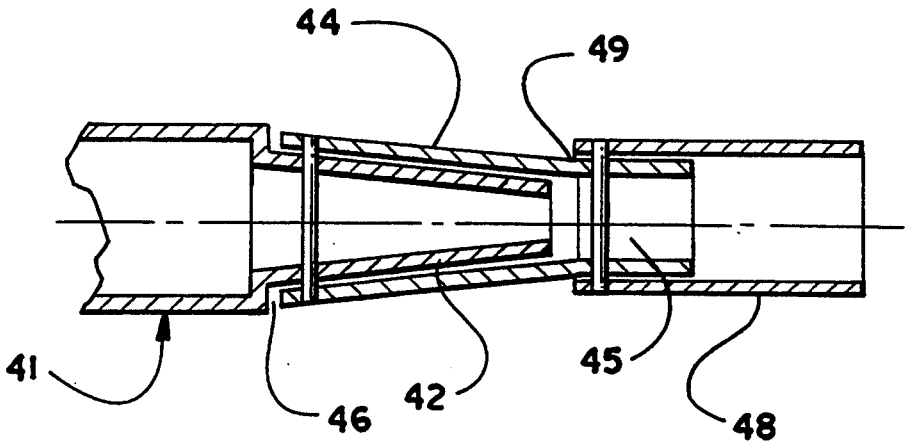
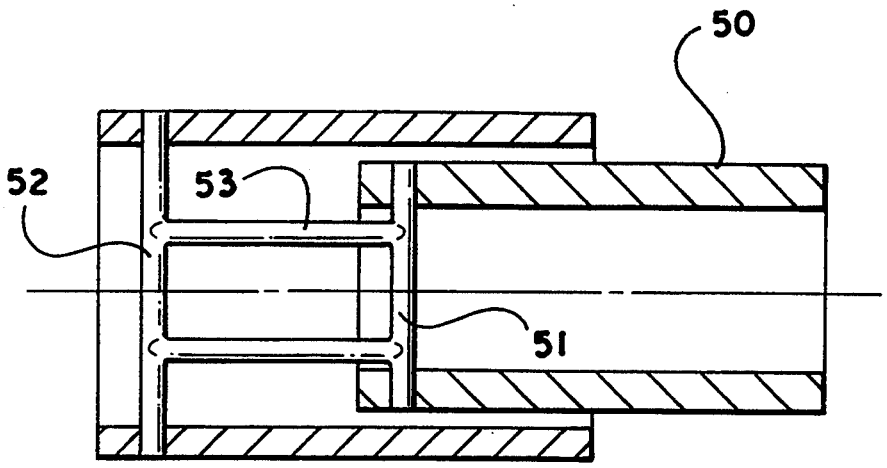
Fig. 9

NOZZLE WITH SELF CONTROLLED OSCILLATION

CROSS-REFERENCE TO RELATED APPLICATION

This application is a continuation-in-part of the copending application of Leary W. Smith, Ser. No. 831,420 filed Feb. 5, 1992, titled "Oscillating Blower Nozzle" now abandoned.

BACKGROUND OF THE INVENTION

1. Field of the Invention

This invention relates generally to fluid discharge nozzles, and is more particularly concerned with an oscillating nozzle wherein fluid flow drives the oscillation of the nozzle.

2. Discussion of the Prior Art

There are numerous prior art nozzles that oscillate, the nozzles being adapted for use with various fluids. One form of oscillating nozzle comprises a flexible member having a whipping action as fluid is discharged therefrom. This type of nozzle is shown in U.S. Pat. No. 2,531,566 to Gustafson, U.S. Pat. No. 3,897,605 to Dickinson and British Patent No. 666,971 (1948). A similar action is used in U.S. Pat. No. 2,620,231 to King, though the King device is for use with liquid.

The most common form of oscillating nozzle for liquid comprises a generally rigid conduit member having a pivoted nozzle member. The arrangement is such that the conduit member is driven in one direction by reaction to discharge of liquid; and, at the predetermined end of travel, mechanical means pivots the pivoted nozzle member to reverse the direction. Such an arrangement is illustrated in U.S. Pat. Nos. 1,712,523, 2,181,227, 1,621,204, and No. 1,491,253.

Another nozzle is disclosed in U.S. Pat. No. 4,526,321 to Knudsen, in FIG. 10 of the drawings. The details of construction of this nozzle are not disclosed, but it will be recognized that the nozzle is designed for use with water under high pressure, so it is clear that the design as dipicted will require pressure-tight joints at the pivot points.

SUMMARY OF THE INVENTION

The present invention provides an oscillating nozzle including at least one generally rigid pivotal segment carried by a generally stationary segment. The stationary segment may comprise a part of the nozzle, or may constitute the outlet of the device that delivers the fluid stream. The pivotal segment is constructed so that the fluid stream, acting on some portion of the nozzle, causes oscillation of the nozzle.

In one embodiment of the invention, a pivotal end segment of the nozzle includes an in-turned lip that is acted on by the fluid stream to drive the oscillation. Such a nozzle may include a single pivotal segment, or a plurality of pivotal segments. Further, the oscillable segment may pivot about a single axis within the confines of the segment, or may pivot about a plurality of pivot points, at least one of which may be outside the confines of the segment.

In another embodiment of the invention, the in-turned lip is omitted, and oscillation is caused by reaction to discharge of the fluid, and inertia of the nozzle segments. Again, the oscillable segments may sometimes include pivot points outside the confines of the nozzle itself.

BRIEF DESCRIPTION OF THE DRAWINGS

These and other features and advantages of the present invention will become apparent from consideration of the following specification when taken in conjunction with the accompanying drawings in which:

FIGS. 8 and 9 are longitudinal cross-sectional views of further modified forms of nozzles made in accordance with the present invention.

DETAILED DESCRIPTION OF THE EMBODIMENTS

Figure 1:
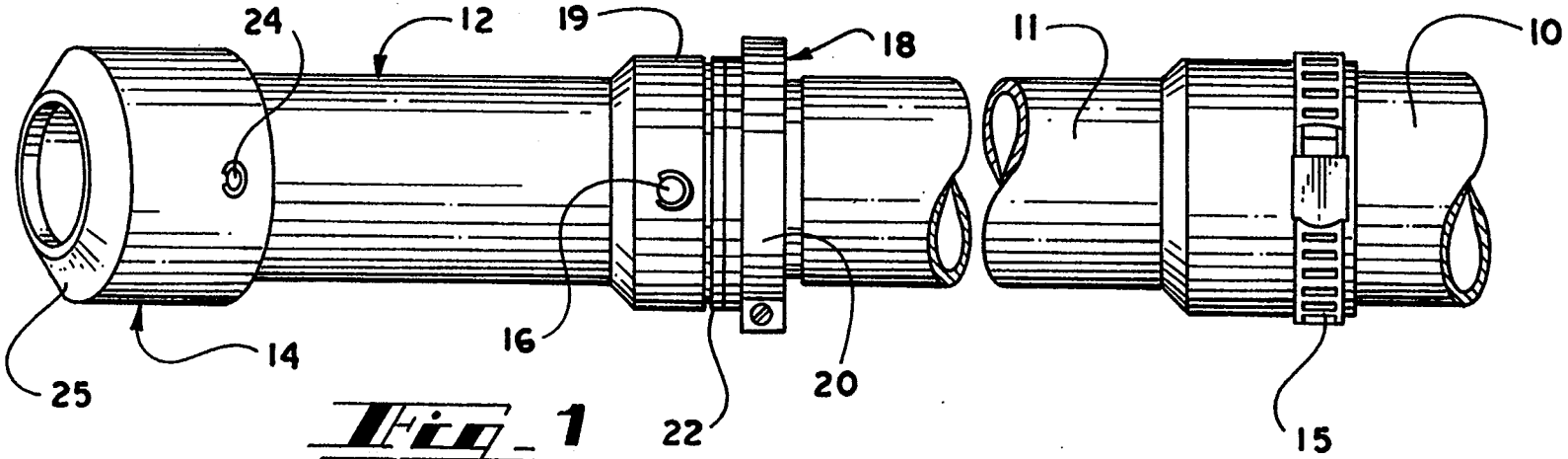
FIG. 1 is a top plan view of a nozzle made in accordance with the present invention having two oscillable segments.

Referring now more particularly to the drawings, and to those embodiments of the invention here chosen by way of illustration, FIG. 1 shows a nozzle for use on a leaf blower or the like. While the leaf blower is chosen by way of illustration, those skilled in the art will realize that the nozzle can be equally well used on other devices that discharge a relatively low pressure stream of air or other gas. FIG. 1 shows the discharge member 10 of a leaf blower or the like, with a stationary nozzle segment 11 fixed to the member 10. The nozzle further includes a first pivotal segment 12 and a second pivotal segment, or nozzle tip, 14 carried by the first pivotal segment. As a result, the total angle through which the nozzle tip 14 pivots will be the pivot angle of the first segment 12 plus the pivot angle of the tip 14.

Figure 2:
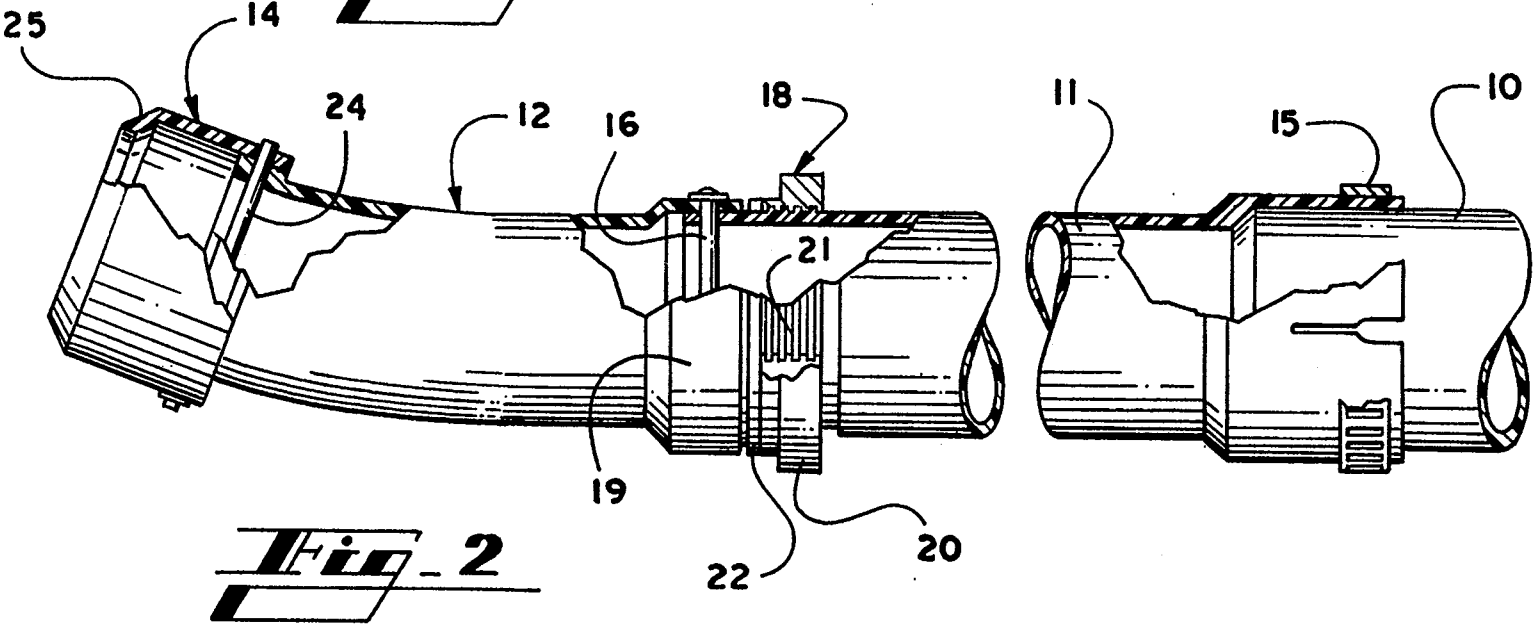
FIG. 2 is a side elevational view, partially in cross-section, of the nozzle shown in FIG. 1.

Considering the details of construction of the nozzle shown in FIG. 1, attention is directed to both FIG. 1 and FIG. 2. The stationary nozzle segment 11 is fixed to the discharge member 10 by a clamp 15, and the first pivotal segment 12 is carried by the stationary segment by a pivot pin 16. At the discharge end of the segment 11, adjacent to the inlet end of the segment 12, there is an adjustable control means generally indicated at 18. The control means 18 limits the angular motion of the pivotal segment 12, and can be adjusted to prevent such motion if desired.

The first pivotal segment 12 has a bell portion 19 that receives the end of the stationary segment 11. The pivot pin 16 passes through the bell 19 and the end of the segment 11 to provide the pivot for the segment 12. Pivotal motion of the segment 12 is limited by the control means 18.

The control means 18 includes a collar 20 threadedly engaged with the segment 11 by threads 21. On the forward edge of the collar 20, there is a shock ring 22, preferably formed of a rubber-like substance. When the collar is rotated in one direction, the shock ring 22 is moved away from the bell 19 of the segment 12, allowing full pivotal motion of the segment 12. When the collar 20 is rotated in the opposite direction, the shock ring 22 is moved towards the bell 19 of the segment 12 to limit pivotal movement, or even to prevent pivotal movement of the segment 12. It will be recognized that other resilient arrangements may be substituted for the rubber-like material of the shock ring.

The second pivotal segment 14 is connected to the segment 12 by a pivot pin 24. It will be noticed that the first segment 12 may be angled somewhat (FIG. 2), so the pivot pins 16 and 24 are in the same plane, but they are not necessarily parallel.

The nozzle tip 14 is generally cylindrical, and has an inwardly turned lip 25 at its discharge end. The control means for the nozzle tip 14 may be the engagement of the tip 14 with the sides of the segment 12, or it may be the fluid's impingement on the inside of the lip 25.

Considering the operation of the device shown in FIGS. 1 and 2, and first assuming the collar 20 is rearwardly enough to allow pivoting of the segment 12, when fluid is passing through the nozzle any imbalance in the nozzle will cause the segment 14 to pivot to one side, so the fluid stream will engage the inside of the lip 25 and drive the segment 14 with a torque about the pivot 24. At the same time, the reaction of the fluid discharging from the segment 14 creates a torque about the pivot 16 to drive both segments. Thus, the oscillable motion of the nozzle is driven by two different forces caused by the same fluid flow. Since both the segments 12 and 14 are pivotal, both segments will move to their extremity. When the extremity is reached, the shifting of the tip 14 in the opposite direction is dependent on fluid impingement on the lip 25. With the shift, the opposite forces will apply, and the segments will move in the opposite direction. This sequence will continue, yielding an oscillatory motion.

It should be realized that the tip 14 moves through a relatively large angle, but is short from pivot to discharge end, while the segment 12 moves through a relatively small angle, but is long from pivot to discharge end. Because of these differences, it is important to have the motions properly synchronized. Moving the control means 18 towards or away from the bell 19 increases or decreases the angle and frequency of oscillation of the segment 12, permitting synchronization of its frequency with that of the tip 14 and resulting in synchronous oscillation of a constant, high frequency. Otherwise the oscillation of the segment 12 may be erratic and not permit the desired oscillation of the tip 14. In this embodiment of the invention, the control means 18 can be adjusted to the point that all motion of the segment 12 is prevented. When this is done, oscillation of the tip 14 is prevented since the design of the tip 14 requires a respondent pivoting movement of the segment 12 for the two segments to oscillate automatically and synchronously.

In view of the foregoing description, it will be understood that the present invention provides an oscillating nozzle for a leaf blower or the like. The nozzle may include two pivotal segments such that one pivotal segment is carried by the other, so the total angle of oscillation is the sum of the pivoting of the two segments. Alternatively, the nozzle may include only one pivotal segment, as the one segment, or nozzle tip, provides the total oscillation.

Figure 2A:
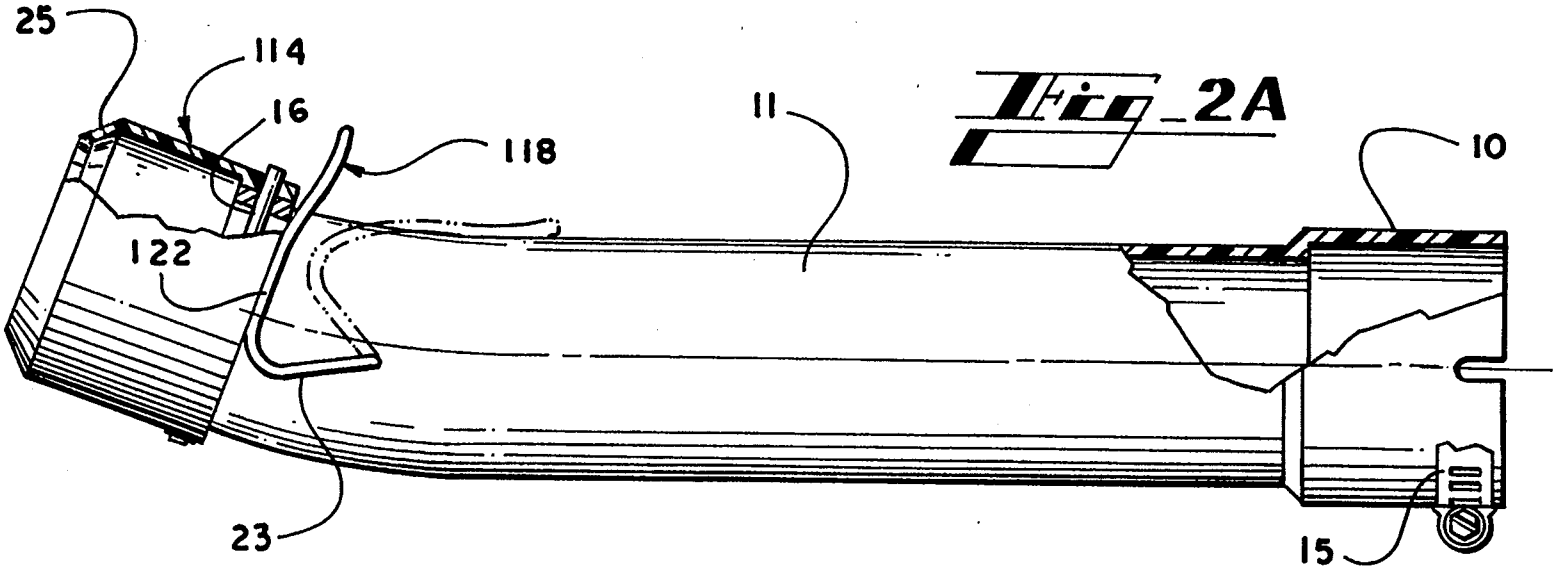
FIG. 2A is a side elevational view of a second embodiment of the invention, having a .single oscillable segment.
Figure 2B:
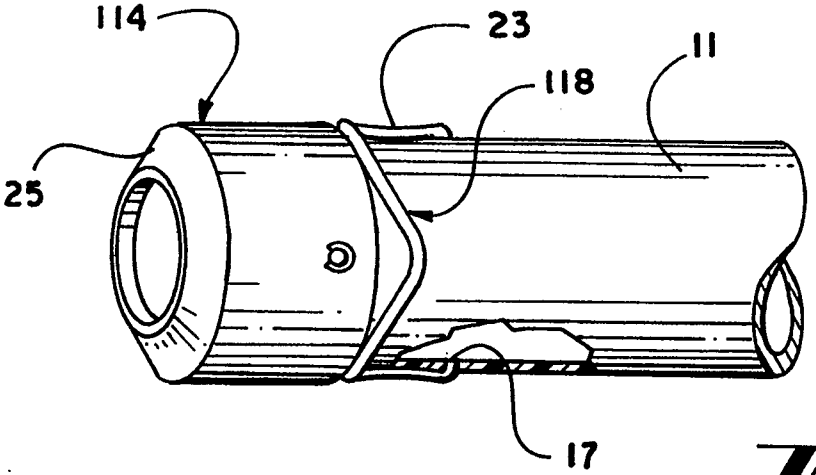
FIG. 2B is a top plan view, partially broken away, of the device shown in FIG. 2A.

FIGS. 2A and 2B disclose another embodiment of the present invention. This embodiment provides an oscillating nozzle tip carried by a generally rigid member which receives a fluid stream from a leaf blower or the like.

FIG. 2A shows the generally rigid member 11 attached to the discharge member 10 of a leaf blower or other source of a fluid stream, and a pivotal nozzle 114 is carried on the discharge end of the generally rigid member 11. Adjacent to the nozzle tip 114 is a locking device attached to the rigid member 11 for preventing oscillation of the tip 114. The discharge end of the tip 114 incorporates an inwardly turned lip 25.

Considering the details of construction shown in FIGS. 2A and 2B, the rigid segment 11 is attached to the discharge member 10 of the blower by a clamp 15, and the pivotal nozzle tip 114 is carried by the rigid segment 11 by a pivot pin 16. The pivot pin 16 passes through the receiving end of the tip 114 and the discharge end of the rigid member 11 for pivoting of the tip 114. The locking device 118 is swivelly attached to the rigid member 11 adjacent to the nozzle member 114 by pintles 17. The pintles 17 are located on a plane with the axis of the tip 114.

Nozzle member 114 is so configured, relative to the rigid member 11, that it will oscillate automatically without additional influence other than the fluid stream being expelled through it. It should be noted that the tip 114 will have a greater length, and a greater mass, than the tip 14, to operate on the same diameter tubing with the same fluid flow characteristics.

Considering the operation of the device shown in FIG. 2A and 2B, and assuming that the locking device 118 is in position to allow oscillation of the nozzle tip 114, when the fluid stream passes through the device, any unbalance of the tip 114 will cause its axis to become misaligned with the axis of the rigid member 11. When this occurs the fluid stream passing through the segment 11 will engage an inside portion of the lip 25. The lip 25 will divert the fluid stream towards the side opposite the lip portion being engaged by the stream, and create a reaction that reverses the swing of the tip 114 to the opposite side of the axis of the rigid member 11, whereupon the above actions are repeated in reverse and automatic oscillation is established in the tip 114. When deactivation of the tip 114 is desired, the locking device 118 is moved to the position shown in solid lines in FIG. 2A, and the locking device portion 122 engages the rear edge of the tip 114 to prevent oscillation thereof. Loops 23 extend past the center of the segment 11 in locked position and are spaced apart less than the diameter of the segment to hold the device in either locked or unlocked position as selected by the operator. Locked position is shown in solid lines in FIG. 2A, and unlocked position is shown in broken lines. Those skilled in the art will realize that other locking means may be employed.

In view of the foregoing description, it will be understood that this embodiment of the invention provides an oscillating nozzle for a leaf blower or the like that is simple and economical to manufacture and maintain. The nozzle may include one pivotal segment carried by a rigid member, with an oscillation angle provided by the tip only, or it may include one pivotal segment carried by a flexible tubular member or the like, having a total oscillation angle of the sum of the oscillatory angle of the tip member plus the flexing angle of the flexing member.

Figure 3:
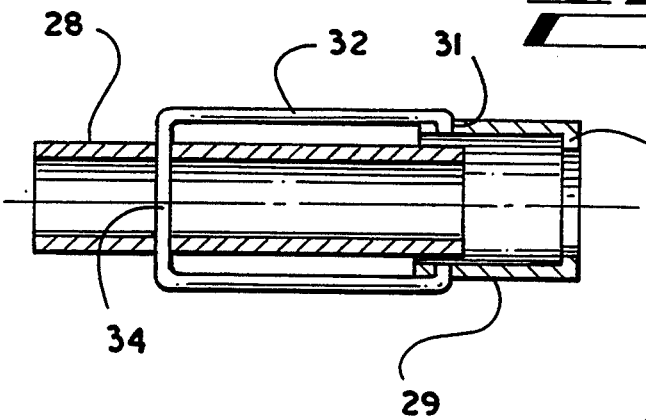
FIG. 3 is a longitudinal, cross-sectional view taken through a modified form of nozzle made in accordance with the present invention.
Figure 4:
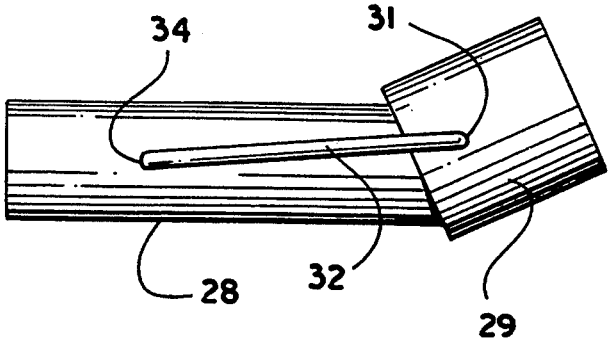
FIG. 4 is a top plan view of the nozzle shown in FIG. 3.

Attention is next directed to FIGS. 3 and 4 for a discussion of a modified form of the invention. In this embodiment, the segment 28 is generally stationary, and the tip 29 pivots on a frame comprising pins 31, arms 32, and an axle 34. The tip 29 includes inwardly turned lips 30 which cause oscillation as discussed above. The axis about which the tip 29 pivots is formed by the pins 31; and, it will be noted that the pins 31 are carried on arms 32 which are pivoted on the axle 34. Thus, the tip 29 is pivotal about the axis of the pins 31 which are within the confines of the tip 29, and also about the axis 34 which is rearwardly, or upstream, of the tip 29.

In view of this construction, the tip 29 will pivot to one side, pivoting about both the axis 34 and the axis 31. In this condition, fluid passing through the segment 28 will also pass through the segment 29. The fluid will impinge on the lip 30 to move the lip out of the fluid stream; also, the discharge of the fluid from the tip 29 in one angular direction will cause a reaction that urges the tip 29 in the opposite direction. The assembly will therefore move in the opposite direction until the segment reaches the limit. The tip 29 will rotate about the axes 31 and 34 and the process will be repeated.

The control means may comprise the engagement of the edge of the tip 29 with the side of the segment 28, or the fluid's impinging on the opposite side of the lip 30 may act as the control. Other control arrangements may be used if desired.

Figure 5:
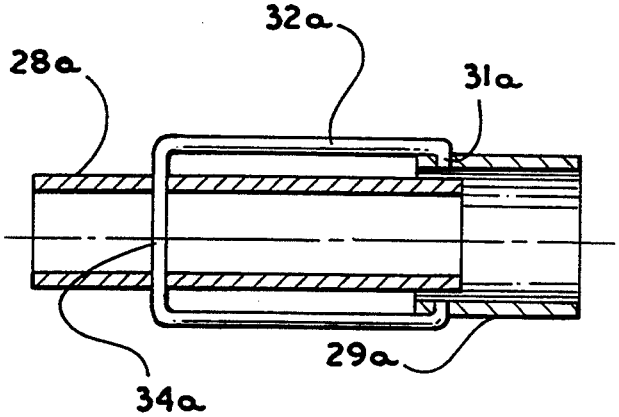
FIG. 5 is a view similar to Fig. 3, but having a different end segment.

Looking at FIG. 5 of the drawings, it will be noticed that the construction is the same as in FIG. 3, but the embodiment of FIG. 5 omits the lip 30. Since the lip 30 is the only difference, FIG. 4 accurately depicts the top plan view of the FIG. 5 embodiment as well as FIG. 3. The embodiment of FIG. 5 includes all the structure described in conjunction with FIG. 3, and the same parts carry the same numerals with an a suffix. In operation, since the device of FIG. 5 has no lip 30, the motion of the tip **29*a* is caused by the reaction of the discharge of the fluid from the tip 29*a*. When the tip 29*a* reaches the opposite extremity, the inertia will cause the tip 29*a* to pivot about the axis 31*a***.

Figure 6:
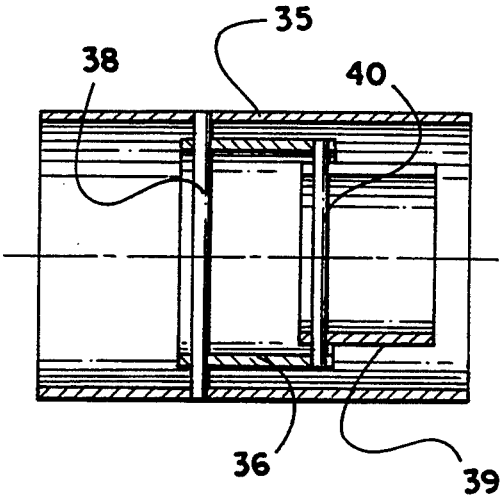
FIG. 6 is a longitudinal cross-sectional view through another modified form of nozzle made in accordance with the present invention.
Figure 7:
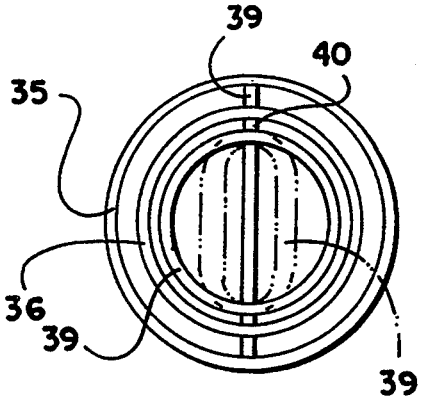
FIG. 7 is a front elevational view of the nozzle shown in FIG. 6.

Attention is now directed to FIGS. 6 and 7 of the drawings. This embodiment of the invention operates similarly to the device disclosed in the above identified co-pending application, and that disclosure is incorporated herein by reference. The difference in the device of FIG. 6 is that the segments of the nozzle are telescoped inward. Thus, there is a stationary segment 35, and a first oscillable segment 36 completely contained within the stationary segment 35. The first oscillable segment 36 is pivoted about the axis 38.

A second oscillable segment 39 is pivotally carried by the first segment 36, the segment, or tip, 39, being pivoted at 40. Thus, both pivoted segments 36 and 39 are housed completely within the stationary segment 35. The reaction of the fluid discharge from the segments drives the segments as is discussed in the co-pending application, and hereinbefore.

To assist in driving the tip 39, the segment 39 may include a central web for impingement of the fluid stream; or, the tip 39 may be laterally flattened, somewhat as shown in broken lines in FIG. 7 of the drawings.

FIG. 8 of the drawings also shows a device similar to that disclosed in the above identified co-pending application. The differences in FIG. 8 are such as to adapt the device to a fluid stream comprising a liquid at relatively high pressure. The stationary segment 41 includes a forwardly extending, frustoconical discharge member 42. The first oscillable segment 44 is shaped to conform to the segment 42. Between the segments 42 and 44, it will be noticed that there is a relatively long path of potential reverse flow that is subject to leakage. Further, the fact that the discharge end of the member 42 is relatively small, and the chamber 45 thereafter is large enough to allow some expansion, results in a venturi effect, creating a negative pressure so there may be some air flow between the members 42 and 44 into the chamber 45. Such flow will also tend to prevent leakage from the joint at 46.

The tip 48 of the nozzle shown in FIG. 8 overlaps the member 44, again providing a relatively long path of reverse flow or possible leakage at the joint 49. As shown in the drawings, there will be a partial venturi effect in the final chamber to prevent leakage. The driving of the nozzle segments for oscillation will be as discussed above, and in the co-pending application.

The device illustrated in FIG. 9 of the drawings comprises two segments, or only one oscillable segment, but the one oscillable segment 50 is pivotable about one axis 51 located at one end of a frame 53, and that one axis 51 is pivotable about a second axis 52 located at the opposite end of the frame 53. The motion is therefore comparable to the device of FIG. 5, and the basic action should be understood without further discussion.

Those skilled in the art should understand that the devices shown in FIGS. 8 and 9 are designed for use with liquids, or rather high pressure gases. As a result, the segments 48 and 50 must have a relatively high mass. Light weight members such as those used for leaf blowers and the like would not have sufficient mass to divert the fluid stream when the stream is liquid, or a high pressure gas. Thus, the segments 48 and 50 have rather thick walls, and may be formed of brass or other relatively heavy material.

In the embodiment of FIG. 9, an advantage of the construction is that the leakage external to the segment 50 is in the same direction, and will be a part of the same stream, as the flow through the segment 50.

From the foregoing discussion it will be understood that the present invention provides nozzles for causing oscillation of a fluid stream. Most of the embodiments of the invention are designed for use with low pressure gas streams, but some may be used with high pressure gas or low to medium pressure liquids. The general principle of operation is substantially the same, but some modifications are required to divert a high energy stream. Thus, it will be obvious to those skilled in the art that the present invention is applicable to a wide variety of devices, such as shop blow guns, hair dryers, industrial heat guns and other drying and heating apparatus, and such as pressure washers shower heads, water hoses, leaf blowers, irrigation nozzles and other cleaning and watering devices. Furthermore, though not disclosed above, an oscillable nozzle made in accordance with the present invention can be mounted in a fluid stream, and the oscillations counted or otherwise monitored for use as an indication of the speed of the fluid stream. The frequency of the oscillations is proportional to the speed of the fluid, so the output will yield a digital indication of speed.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

We claim:

1. A nozzle for providing an oscillating fluid flow, said nozzle being connected for receiving fluid from a fluid source which provides a fluid stream, said nozzle comprising a stationary segment having an outlet end for delivering said fluid stream therefrom, an oscillating segment pivotally connected to said stationary segment at said outlet end of said stationary segment, said oscillating segment having an inlet end for receiving said fluid stream and an outlet end through which said fluid stream is discharged, said oscillating segment being substantially rigid, pivot means for pivotally connecting said oscillating segment to said stationary segment, said pivot means being located adjacent to said inlet end of said oscillating segment, and an inwardly turned lip on said oscillating segment, said inwardly turned lip causing oscillation of said oscillating segment and said fluid stream, wherein said inwardly turned lip is adjacent to said outlet end of said oscillating segment for directly receiving fluid force to cause said oscillation of said oscillating segment so that one portion of said inwardly turned lip moves out of said fluid stream and causes another portion of said lip to move into said fluid stream.

2. A nozzle as claimed in claim 1, and further including control means for limiting pivotal motion of said oscillating segment.

3. A nozzle as claimed in claim 2, said control means comprising engagement of said stationary segment by said oscillating segment.

4. A nozzle as claimed in claim 2, wherein said control means comprises the force of said stream against said lip.

5. A nozzle for providing an oscillating fluid flow, said nozzle being connected for receiving fluid from a fluid source for providing a fluid stream, said nozzle comprising a stationary segment having an inlet end to receive said stream from said source, and an outlet end downstream of said inlet end, said inlet end and said outlet end each having inside surfaces in direct contact with said fluid stream for containment of said stream, a first oscillating segment received within said stationary segment and pivotally connected to said stationary segment between said inlet end and said outlet end, said first oscillating segment being substantially rigid, first pivot means for pivotally connecting said first oscillating segment to said stationary segment, a second pivot means received within said stationary segment, said second pivot means being downstream from said first pivot means and pivotal about said first pivot means, a second oscillating segment, said second oscillating segment being substantially rigid and pivotally connected to said first oscillating segment by said second pivot means, said second oscillating segment having an inlet end for receiving at least a portion of said stream, an outlet end for discharging said at least a portion of said fluid stream, so that oscillation of said first and second oscillating segments is caused by reactive thrust of discharging said at least a portion of said stream and interaction between the substantially rigid segments.

6. A nozzle as claimed in claim 5, wherein said outlet end of said second oscillating segment is adjacent to said outlet end of said stationary segment.

7. A nozzle as claimed in claim 5, said oscillating segments being dimensioned such that a portion of said fluid stream passes between said stationary segment and said second oscillating segment.

8. A nozzle for providing an oscillating fluid flow, said nozzle being connected for receiving fluid from a fluid source which provides a fluid stream, said nozzle comprising a stationary segment having an inlet end to receive said stream from said source, said inlet end and said outlet end each having inside surfaces in direct contact with said fluid stream for containment of said stream, and an outlet end downstream from said inlet end, substantially rigid frame means pivotally connected to said stationary segment, first pivot means for pivotally connecting said frame means to said stationary segment between said inlet end and said outlet end, second pivot means downstream from said first pivot means and pivotal about said first pivot means, and an oscillating segment, said oscillating segment being substantially rigid and connected to said frame means by said second pivot means, said oscillating segment having an inlet end for receiving said stream from said outlet end of said stationary segment, and an outlet end for discharging said stream, the arrangement being such that oscillation is caused by reactive thrust of discharging said stream and interaction between said substantially rigid segments.

9. A nozzle for providing an oscillating fluid flow, said nozzle being connected for receiving fluid from a fluid source which provides a fluid stream, said nozzle comprising a stationary segment having an outlet end for delivering said fluid stream, a first oscillating segment pivotally connected to said outlet end of said stationary segment, said first oscillating segment having an inlet end for receiving said stream and an outlet end for delivering said stream, first pivot means for pivotally connecting said first oscillating segment to said stationary segment, a second oscillating segment pivotally connected to said outlet end of said first oscillating segment, said second oscillating segment having an inlet end for receiving said stream and an outlet end for discharging said stream, second pivot means for pivotally connecting said second oscillating segment to said first oscillating segment, said second pivot means being adjacent to said outlet end of said first oscillating segment and adjacent to said inlet end of said second oscillating segment, an inwardly turned lip on said second oscillating segment adjacent to said outlet end of said second oscillating segment, said inwardly turned lip causing oscillation of said oscillating segments and said stream, and control means for adjustably limiting oscillation of said first oscillating segment.

* * * * *